US005668081A

United States Patent [19]

Simpson et al.

[11] Patent Number: 5,668,081

[45] Date of Patent: Sep. 16, 1997

[54] THERMAL DYE TRANSFER DYE-DONOR ELEMENT WITH TRANSFERABLE PROTECTION OVERCOAT

[75] Inventors: William Henry Simpson, Pittsford; David P. Brust, Rochester; Jacob John Hastreiter, Jr., Spencerport; Mary Catherine S. Oldfield, Rochester, all of N.Y.

[73] Assignee: Eastman Kodak Company, Rochester, N.Y.

[21] Appl. No.: 684,899

[22] Filed: Jul. 25, 1996

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 428/500, 913, 914, 341; 503/227

[56] References Cited

U.S. PATENT DOCUMENTS 4,977,136 12/1990 Fujiwara et al. ..... 503/227

5,006,502 4/1991 Fujiwara et al. ..... 503/227

5,332,713 7/1994 Oldfield et al. ..... 503/227

*Primary Examiner*—Bruce H. Hess

*Attorney, Agent, or Firm*—Harold E. Cole

[57] ABSTRACT

A dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer comprises either a) poly(vinyl formal), poly(vinyl benzal) or poly(vinyl acetal) containing at least about 5 mole % hydroxyl and a crosslinking agent, or b) a phenoxy resin.

17 Claims, No Drawings

THERMAL DYE TRANSFER DYE-DONOR ELEMENT WITH TRANSFERABLE PROTECTION OVERCOAT

This invention relates to a dye-donor element for thermal dye transfer, and more particularly to the use of a transferable protection overcoat in the element for transfer to a thermal print.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. Also, dye fading may occur from fingerprint marking because the image dyes are located at the surface. These dyes can be driven further into the dye-receiving layer by thermally fusing the print with either hot rollers or a thermal head. This will help to reduce dye retransfer and fingerprint susceptibility, but does not eliminate these problems. However, the application of a protective overcoat will practically eliminate these problems.

U.S. Pat. No. 5,332,713 discloses a dye-donor element for thermal dye transfer wherein a transparent protection overcoat is also present on the element which is used to form a protective layer over the printed image. These protective overcoats work very well with thermally printed material which is used as a photographic reproduction.

However, there is a problem with the application of a protective overcoat to a thermally-generated image on an identification card, such as a driver's license, because of the additional requirement of resistance to chemical attack by solutions or solvents such as water/alcohol mixtures, household bleach, automobile fuel, and organic solvents. Since the protective layers commonly used are coated from solutions composed of the dissolved polymer and a solvent, the resultant protective layer can be easily redissolved.

It is an object of this invention to provide a protective coat for a thermal dye transfer image which can be applied by the thermal print head, and which is resistant to chemical degradation.

These and other objects are achieved in accordance with this invention which relates to a dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer comprises either a) poly(vinyl formal), poly(vinyl benzal) or poly(vinyl acetal) containing at least about 5 mole % hydroxyl and a crosslinking agent, or b) a phenoxy resin.

In a preferred embodiment of the invention, the dye-donor element is a multicolor element comprising repeating color patches of yellow, magenta and cyan image dyes, respectively, dispersed in a binder, and a patch containing the protection layer.

In another embodiment of the invention, the protection layer is the only layer on a donor element and is used in conjunction with another dye-donor element which contains the image dyes.

In another preferred embodiment of the invention, the dye-donor element is a monochrome element and comprises repeating units of two areas, the first area comprising a layer of one image dye dispersed in a binder, and the second area comprising the protection layer.

In another preferred embodiment of the invention, the dye-donor element is a black-and-whim element and comprises repeating units of two areas, the first area comprising a layer of a mixture of image dyes dispersed in a binder to produce a neutral color, and the second area comprising the protection layer.

Examples of a poly(vinyl formal), poly(vinyl benzal) or poly(vinyl acetal) containing at least about 5 mole % hydroxyl are disclosed in the above-mentioned U.S. Pat. No. 5,332,713, the disclosure of which is hereby incorporated by reference.

Any phenoxy resin known to those skilled in the art may be used in the invention. For example, there may be employed the following: Paphen® resins such as Phenoxy Resins PKHC, PKHH and PKHJ from Phenoxy Associates, Rock Hill, S.C.; and 045A and 045B resins from Scientific Polymer Products, Inc. Ontario, N.Y. which have a mean number molecular weight of greater than about 10,000. In a preferred embodiment of the invention, the phenoxy resin is a Phenoxy Resin PKHC, PKHH or PKHJ having the following formula:

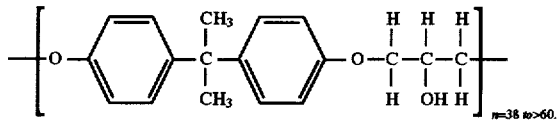

Various crosslinking agents may be employed in the invention such as titanium alkoxides, polyisocyanates, melamine-formaldehyde, phenol-formaldehyde, urea-formaldehyde, vinyl sulfones and silane coupling agents such as tetraethylorthosilicate. In a preferred embodiment of the invention, the crosslinking agent is a titanium alkoxide such as titanium tetra-isopropoxide or titanium butoxide.

The above materials are effective crosslinking agents for the protective layer polymers which contain active groups, such as acetal or hydroxyl. This protective layer can be formulated to give good pot stability during gravure coating, and the crosslinking agents have a very high rate of reaction with the polymer as the solvents evaporate from the coated fill. In general, good results have been obtained when the crosslinking agent is present in an mount of from about 0.01 $g/m^2$ to 0.045 $g/m^2$.

It should be noted that a blend of crosslinkable polymers, or a co-polymer which can be crosslinked, will yield the same results as those obtained with single polymers in the protection layer.

The present invention provides a protective overcoat layer applied to a thermal print by uniform application of heat using a thermal head. After transfer to the thermal print, the protective layer provides superior protection against image deterioration due to exposure to light, common chemicals, such as grease and oil from fingerprints, and plasticizers from film album pages or sleeves made of poly(vinyl chloride). The protection layer is generally applied in a concentration of at least about 0.05 g/m$^2$.

Yellow, magenta and cyan dyes can be thermally transferred from a dye-donor element to form a multicolor image on the dye-receiving sheet. The thermal head is then used to transfer a clear protective layer, from another clear patch on the dye-donor element or from a separate donor element, onto the imaged receiving sheet by uniform application of heat. The clear protective layer adheres to the print and is released from the donor support in the area where heat is applied.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

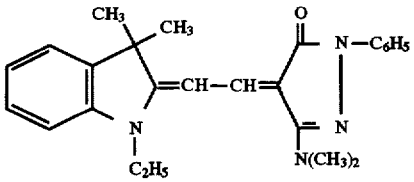

Yellow Dye

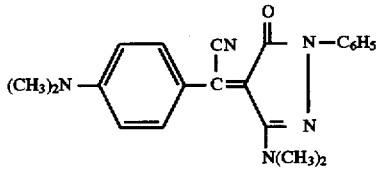

Magenta-1 Dye

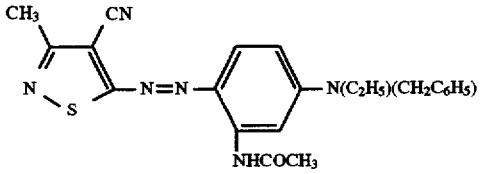

Magenta-2 Dye

-continued

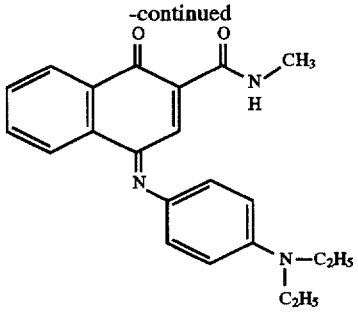

Cyan-1 Dye

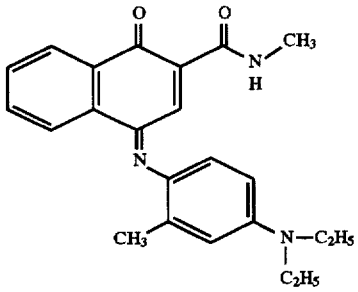

Cyan-2 Dye

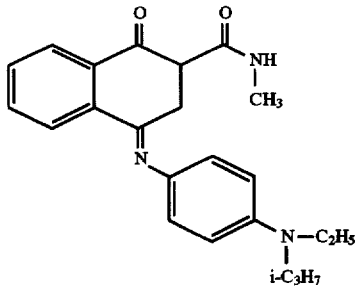

Cyan-3 Dye or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly (vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable and can withstand the heat of the thermal printing heads. Such materials include polyesters such as poly(ethylene terephthalate); poly(ethylene naphthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

The following examples are provided to illustrate the invention.

EXAMPLE 1

Dye-donor elements were prepared by coating on a 6 μm poly(ethylene terephthalate) support:

1) a subbing layer of titanium butoxide (DuPont Tyzor TBT)® (0.13 g/m$^2$) from a n-propyl acetate and n-butyl alcohol solvent mixture, and 2) repeating yellow, magenta and cyan dye patches containing the compositions and a protective layer as described below.

On the back side of the element were coated the following layers in sequence:

1) a subbing layer of titanium butoxide (DuPont Tyzor TBT)® (0.13 g/m$^2$) from n-butyl alcohol solvent, and 2) a slipping layer containing an aminopropyl-dimethyl-terminated polydimethylsiloxane, PS513® (United Chemical Technologies, Bristol, Pa.)(0.01 g/m$^2$), a poly (vinyl acetal) binder (0.38 g/m$^2$), p-toluenesulfonic acid (0.0003 g/m$^2$), candelilla wax (0.02 g/m$^2$), coated from a solvent mixture of toluene, methanol and cyclopentanone (66.5/28.5/5).

The yellow composition contained 0.27 g/m$^2$ of the yellow dye illustrated above, 0.07 g/m$^2$ of CAP 482-0.5 (cellulose acetate propionate) 0.5 s viscosity (Eastman Chemical Co.), 0.287 g/m$^2$ of CAP 482-20 (cellulose acetate propionate) 20 s viscosity (Eastman Chemical Co.), 0.002 g/m$^2$ of FC-430® fluorocarbon surfactant (3M Corp.) in a solvent mixture of toluene, methanol and cyclopentanone (66.5/28.5/5).

The magenta composition contained 0.18 g/m$^2$ of the Magenta dye-1 illustrated above, 0.17 g/m$^2$ of Magenta dye-2 illustrated above, 0.17 g/m$^2$ of CAP 482-0.5 (cellulose acetate propionate) 0.5 s viscosity (Eastman Chemical Co.), 0.31 g/m$^2$ of CAP 482-20 (cellulose acetate propionate) 20 s viscosity (Eastman Chemical Co.), 0.07 g/m$^2$ of 2,4,6-trimethylanilide of phenyl-indane-diacid, 0.002 g/m$^2$ of FC-430® fluorocarbon surfactant (3M Corp.) in a solvent mixture of toluene, methanol and cyclopentanone (66.5/28.5/5).

The cyan composition contained Cyan Dye-1 at 0.127 g/m$^2$, Cyan Dye-2 at 0.115 g/m$^2$, Cyan Dye-3 at 0.275 g/m$^2$, 0.30 g/m$^2$ of CAP 482-20 (cellulose acetate propionate) 20 s viscosity (Eastman Chemical Co.), and Fluorad FC-430® fluorocarbon surfactant (3M Corp.) (0.002 g/m$^2$) in a solvent mixture of toluene, methanol and cyclopentanone (66.5/28.5/5).

C-1 (Control Dye Donor Element)

The transferable overcoat material was poly(vinyl acetal) at a laydown of 0.538 g/m$^2$, 4 μm divinylbenzene beads at 0.086 g/m$^2$, and a microgel (67 mole % isobutyl methacrylate, 30 mole % 2-ethylhexyl methacrylate, 3 mole % divinylbenzene) at 0.011 g/m$^2$. The control was coated from diethyl ketone solvent.

E-1 (Dye-Donor Element of the Invention)

This element was the same as C-1 except that Tyzor® TBT (a titanium butoxide from DuPont) was added at a laydown of 0.022 g/m$^2$.

E-2 (Dye-Donor Element of the Invention)

This element was the same as C-1 except that the transferable overcoat material area contained PKHJ phenoxy resin from Phenoxy Associates at a laydown of 0.538 g/m$^2$ coated from a toluene, n-propanol, cyclopentanone (65/30/5) solvent mixture.

E-3 (Dye-Donor Element of the Invention)

This element was the same as E-2 except that Tyzor® TBT was added at a laydown of 0.022 g/m$^2$.

E-4 (Dye-Donor Element of the Invention)

The transferable overcoat material was the phenoxy resin of E-2 at a laydown of 1.08 g/m$^2$, 4 μm divinylbenzene beads at 0.086 g/m$^2$, the above microgel of C-1 at 0.011 g/m$^2$ and Tyzor® TBT at 0.043 g/m$^2$.

E-5 (Dye-Donor Element of the Invention)

The transferable overcoat material was the phenoxy resin of E-2 at a laydown of 0.538 g/m$^2$, 4 μm divinylbenzene beads at 0.086 g/m$^2$, and Tyzor® TBT at 0.22 g/m$^2$ (no microgel).

B. Receiver Element

The receiver element consisted of four layers coated on 7 mil (175 μm) Estar® (poly(ethylene terephthalate) (Eastman Kodak Co.) support. Since the important interaction for successful transfer of a protective layer takes place between protective layer and the topmost layer of the receiver element, the support of the latter acts only as a carrier of the receiver layers and may consist of any material compatible with the bottom-most receiver layer.

The first layer, which was coated directly on the support, consisted of a copolymer of butyl acrylate and acrylic acid (50/50 wt. %) at 8.070 g/m$^2$, 1,4-butanediol diglycidyl ether (Eastman Kodak Co.) at 0.565 g/m$^2$, tributylamine at 0.323 g/m$^2$, FC431 ® surfactant (3M Corporation) at 0.016 g/m$^2$.

The second layer consisted of a copolymer of 14 mole % acrylonitrile, 79 mole % vinylidine chloride and 7 mole % acrylic acid at 0.538 g/m$^2$, and DC-1248 silicone fluid (Dow Corning) at 0.016 g/m$^2$.

The third layer consisted of Makrolon® KL3-1013 polycarbonate (Bayer AG) at 1.775 g/m$^2$, Lexan® 141-112 polycarbonate (General Electric Co.) at 1.453 g/m$^2$, FC431® at 0.011 g/m$^2$, dibutyl phthalate (Eastman Kodak Co.) at 0.323 g/m$^2$, and diphenyl phthalate at 0.323 g/m$^2$.

The fourth, and topmost layer of the receiver element, consisted of a copolymer of 50 mole-% bisphenol A, 49 mole-% diethylene glycol and 1 mole % of a poly (dimethylsiloxane) block at a laydown of 0.646 g/m$^2$, FC431® at 0.054 g/m$^2$, and DC510 silicone fluid surfactant (Dow Corning) at 0.054 g/m$^2$.

The layers above could also have been coated on a support in reverse order and then transferred to another material, such as a decorative plaque, again resulting in the topmost layer being compatible with the protective overcoat layer.

C. Printing Conditions

The dye side of the dye-donor element was placed in contact with the topmost layer of the receiver element as described above. The assemblage was placed between a motor driven platen (35 mm in diameter) and a Kyocera KBE-57-12MGL2 thermal print head which was pressed against the slip layer side of the dye donor element with a force of 31.2 Newtons.

The Kyocera print head has 672 independently addressable heaters with a resolution of 11.81 dots/mm of average resistance 1968 ohms. The imaging electronics were activated and the assemblage was drawn between the printing head and the roller at 26.67 mm/s.

Coincidentally, the resistance elements in the thermal print head were pulsed on for 87.5 1 μs every 91 μs. Printing maximum density required 32 pulses "on" time per printed line of 3.175 milliseconds. The voltage supplied was 14.0 volts resulting in an energy of 4.4 J/cm$^2$ to print a maximum Status A density of 2.2 to 2.3. The image was printed with a 1:1 aspect ratio. The protective layer was transferred to the printed receiver by heating uniformly at an energy level of 3.3 J/cm$^2$ with the thermal head to permanently adhere the polymeric film to the topmost layer of the receiver element.

D. Determination of Chemical Resistance

After transferring the protective layer to the topmost layer of the receiver element, the Status A density of a cyan bar which appeared in the image was measured at two different places and the average density recorded. The red Status A density of the cyan colored bar was about 2.2. The protected receiver elements were immersed in each of the solvents listed in Table 1 for the duration noted. The receiver sample was then removed from the solvent and air dried for solvents 1,5 and 6. The sample was rinsed in deionized water and then dried for solvents 2,3 and 4. After drying, the Status A density of the cyan colored bar was reread at the same locations and the average density recorded. The percent loss of cyan dye density in the colored bar was calculated from the following formula:

$$\% \text{ LOSS}=\{(I-F)/I\}\times 100$$

where

I=Initial Status A Density and

F=Final Status A Density

The lower the value of % Loss, the better the performance of the protective overcoat layer, i.e., the better the resistance to chemical degradation of the imaged element. Table 2 shows the data collected for the above donor elements when they were subjected to the solvents of Table 1 below.

TABLE 1

Solvents Used and Test Conditions in Chemical Resistance Testing

| Solvent # | Composition | Duration of Exposure |
|---|---|---|
| 1 | 100% isopropanol | 4 hours |
| 2 | 60% ethanol + 40% water | 4 hours |
| 3 | undiluted household bleach (5.25% sodium hypochlorite | 4 hours |
| 4 | 50% ethylene glycol + 50% water | 4 hours |
| 5 | synthetic fuel (30% toluene + 70% isooctane) | 2 hours |
| 6 | 100% trichloroethylene | 1 minute |

TABLE 2

| Solvent | Loss of Density (%) | | | | | |
|---|---|---|---|---|---|---|
| # | C-1 | E-1 | E-2 | E-3 | E-4 | E-5 |
| 1 | 43 | 38 | 33 | 29 | 11 | 23 |
| 2 | 26 | 26 | 16 | 13 | 5 | 12 |
| 3 | 65 | 24 | (1) | (2) | 0.2 | 1 |
| 4 | 2.5 | 0.4 | 0 | 0 | 0 | 4 |
| 5 | 45 | 19 | 27 | 1 | 1 | 0.4 |
| 6 | 88 | 96 | 83 | 68 | 61 | 72 |

The above results show that the dye-donor elements of the invention have less density loss and therefore provide greater resistance to most solvents in the majority of instances when compared to the control element.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon at least one dye layer area comprising an image dye in a binder and another area comprising a transferable protection layer, said transferable protection layer area being approximately equal in size to said dye layer area, wherein said transferable protection layer comprises either a) poly(vinyl formal), poly(vinyl benzal) or poly(vinyl acetal) containing at least about 5 mole % hydroxyl and a crosslinking agent, or b) a phenoxy resin and a crosslinking agent.

2. The element of claim 1 wherein said phenoxy resin comprises

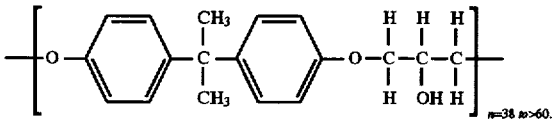

3. The element of claim 1 wherein said transferable protection layer comprises poly(vinyl acetal) containing at least about 5 mole % hydroxyl and a crosslinking agent.

4. The element of claim 3 wherein said crosslinking agent is a titanium alkoxide.

5. The element of claim 4 wherein said titanium alkoxide is titanium butoxide and is present in an amount from about 0.01 $g/m^2$ to 0.045 $g/m^2$.

6. The element of claim 1 wherein said dye-donor element is a multicolor element comprising repeating color patches of yellow, magenta and cyan image dyes, respectively, dispersed in a binder, and a patch containing said protection layer.

7. A process of forming a protection layer on top of a thermal dye transfer image comprising:

(I) imagewise-heating a dye-donor element comprising a support having thereon a dye layer comprising an image dye in a binder, said dye-donor being in contact with a dye-receiving element, thereby transferring a dye image to said dye-receiving element to form said dye transfer image; and (II) thermally transferring a protection layer on top of said transferred dye image, said protection layer being applied from an element which contains either a) poly(vinyl formal), poly(vinyl benzal) or poly(vinyl acetal) containing at least about 5 mole % hydroxyl and a crosslinking agent, or b) a phenoxy resin and a crosslinking agent.

8. The process of claim 7 wherein said protection layer is present on a separate area of said dye-donor element.

9. The process of claim 7 wherein said protection layer is present on a separate donor element.

10. The process of claim 7 wherein said phenoxy resin comprises

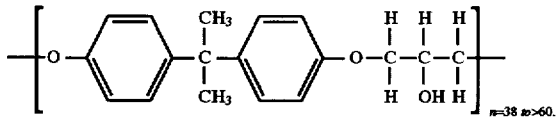

11. The process of claim 7 wherein said transferable protection layer comprises poly(vinyl acetal) containing at least about 5 mole % hydroxyl and a crosslinking agent.

12. The process of claim 7 wherein said dye-donor element is a multicolor element comprising repeating color patches of yellow, magenta and cyan image dyes, respectively, dispersed in a binder, and a patch containing said protection layer.

13. A thermal dye transfer assemblage comprising (A) a dye-donor element for thermal dye transfer comprising a support having thereon at least one dye layer area comprising an image dye in a binder and another area comprising a transferable protection layer, said transferable protection layer area being approximately equal in size to said dye layer area, and (B) a dye receiving element comprising a support having thereon a dye image-receiving layer, said dye-receiving element being in a superposed relationship with said dye-donor element so that said dye layer is in contact with said dye image-receiving layer; wherein said transferable protection layer comprises either a) poly(vinyl formal), poly(vinyl benzal) or poly(vinyl acetal) containing at least about 5 mole % hydroxyl and a crosslinking agent, or b) a phenoxy resin and a crosslinking agent.

14. The assemblage of claim 13 wherein said phenoxy resin comprises

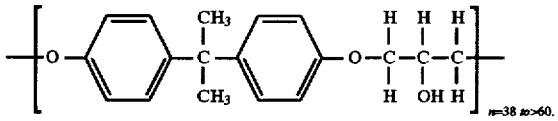

15. The assemblage of claim 13 wherein said transferable protection layer comprises poly(vinyl acetal) containing at least about 5 mole % hydroxyl and a crosslinking agent.

16. The assemblage of claim 13 wherein said crosslinking agent is titanium butoxide and is present in an amount from about 0.01 $g/m^2$ to 0.045 $g/m^2$.

17. The assemblage of claim 13 wherein said dye-donor element is a multicolor element comprising repeating color patches of yellow, magenta and cyan image dyes, respectively, dispersed in a binder, and a patch containing said protection layer.

* * * * *